United States Patent [19]

Ludowici

[11] 4,262,464

[45] Apr. 21, 1981

[54] WALL FACING ASSEMBLY

[76] Inventor: Michael C. Ludowici, 5-7 Josef-Wiesberger Str., D-8013 Haar, Fed. Rep. of Germany

[21] Appl. No.: 897,509

[22] Filed: Apr. 18, 1978

[30] Foreign Application Priority Data

| | | | |
|---|---|---|---|
| Apr. 21, 1977 | [DE] | Fed. Rep. of Germany | 2717798 |
| Dec. 15, 1977 | [DE] | Fed. Rep. of Germany | 2756062 |
| Dec. 15, 1977 | [DE] | Fed. Rep. of Germany | 2756063 |
| Dec. 27, 1977 | [DE] | Fed. Rep. of Germany | 2758286 |
| Mar. 8, 1978 | [DE] | Fed. Rep. of Germany | 2810039 |
| Mar. 20, 1978 | [DE] | Fed. Rep. of Germany | 2812223 |

[51] Int. Cl.[3] ..... E04B 1/38

[52] U.S. Cl. ..... 52/510; 52/394; 52/512; 52/550

[58] Field of Search ..... 52/385, 386, 387, 506, 52/509, 510, 512, 394, 478, 763, 772, 546, 547, 550, 596, 604, 235, 606

[56] References Cited

U.S. PATENT DOCUMENTS

| | | | |
|---|---|---|---|
| 365,295 | 6/1887 | Bright | 52/763 |
| 664,705 | 12/1900 | Anderson | 52/510 X |
| 1,542,882 | 6/1925 | Hoffman et al. | 52/510 X |
| 2,262,973 | 11/1941 | Sonnenschein | 52/509 |
| 3,110,131 | 11/1963 | Jeffress | 52/235 X |
| 3,640,043 | 2/1972 | Querfeld et al. | 52/235 X |

FOREIGN PATENT DOCUMENTS

| | | | |
|---|---|---|---|
| 29362 | 4/1884 | Fed. Rep. of Germany . | |
| 1236537 | 6/1971 | United Kingdom | 52/235 |

*Primary Examiner*—Carl D. Friedman
*Attorney, Agent, or Firm*—Christie, Parker & Hale

[57] ABSTRACT

A wall facing assembly comprised of wall facing panels and suspension rails. The panels have offset top and bottom ribs which cooperate with each other and the suspension rails.

28 Claims, 16 Drawing Figures

Figure 1:
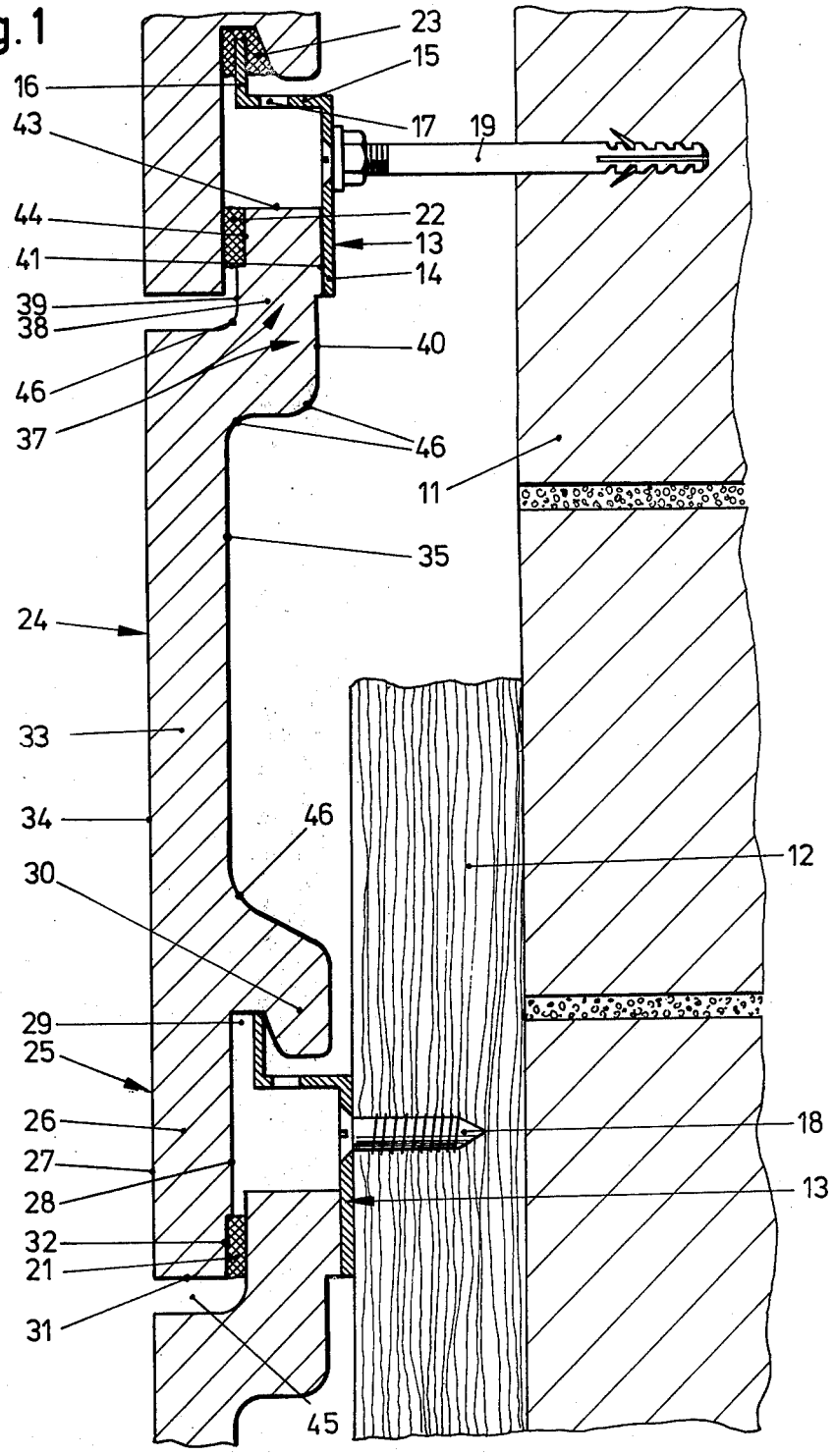

24,24'
33
30
29
16
13
14
15
26
31

24'
b mm
α
a
L 24
16
29
13
26
32
21
39
29
24'
33'
26'
30
18
38
37
14
40
30'
18
11
12

WALL FACING ASSEMBLY

This invention relates to a wall facing assembly comprised of wall facing panels formed by extrusion from ceramic materials. The employed facing panels are not provided with a so-called circumferential grooving. The finished wall facing assembly should conform to the specification of a lightweight facing, with a maximum weight of 50 kp/m$^2$ of the panels forming the wall facing. The wall facing assembly and its facing panels should preferably be designed with a view to rear side ventilation, i.e. between the wall facing assembly consisting of the facing panels and the wall masonry or other support structure there should be provided an air gap for permitting adequate rear side ventilation.

There are already known several wall facing assemplies formed from wall facing panels, wherein each facing panel or every second or third facing panel has to be fastened individually, however, to the respective support structure. This requires a substantial amount of manual labour for mounting such wall facing assemblies at the building site, with a corresponding increase in costs. In addition, it is extremely inconvenient for the operator assembling the facing panels to have to carry with him the requisite fastening elements, such as screws, nails or the like, in addition to the tools required for fastening such elements, so that the assembling operation becomes rather time-consuming.

Further known are wall facing assemblies comprised of facing panels, wherein the individual panels do not have to be fastened separately. These facing panels are provided, however, with a so-called circumferential grooving rendering difficult not only the production but also the assembling of the facing panels, and in addition rendering virtually impossible the replacement of facing panels in case of damage thereto.

Also known are wall facing assemblies comprised of facing panels having key and groove engagement means in the longitudinal and transverse direction. A disadvantage of any key and groove connection consists in the requirement that the groove as well as the key have to be formed extremely accurately in order on the one hand to provide for perfect alignment of the facing panels relative to one another and on the other hand, to effectively prevent rattling of the wall facing assembly. Particularly in the case of hard building materials having an extremely low modulus of elasticity, a close fit may result in breakage or other damage of the key or the groove due to slight misalignment resulting from the manner of fastening, from an uneven support structure or from slight shape deviations in the panels themselves.

Particularly in the field of coarse ceramics it is virtually impossible to form keys and grooves with the requisite accuracy due to the drying and firing process. For this reason, either the groove has to be formed rather wide, or the keys have to be formed relatively narrow in order to allow for the said misalignment. As a consequence, however, the groove and key engagement will not function properly, and wind will cause the facing panels to rattle. This is not only annoying, but may also lead to fatigue damage of the facing panels.

Finally there are also known wall facing assemblies comprising facing panels having a circumferential grooving as well as a kind of a groove-and-key engagement means particularly along the horizontal joints. In this particular embodiment of the facing panels forming the facing assembly, the key is generally formed as a continuous key, while the groove receiving the key substantially consists of two hook-shaped elements. This construction obviously has the purpose to avoid the disadvantageous effects of any deformations as referred to above. The disadvantage of this construction, however, lies in the fact that the individual hook-shaped elements either have to be rather narrow, in which case they may easily break off, particularly during transport and assembly, or they are formed relatively wide, in which case they lose their ability of compensating for possible deformations.

These facing panels also have the disadvantage that replacement thereof is impossible or extremely difficult, and in particular that the insertion of a facing panel to replace a damaged one at a later date is rendered practically impossible by the type of mounting employed.

The invention therefore is directed to a wall facing assembly capable of rear side ventilation, the facing panels of which are capable of being produced, preferably by extrusion of a ceramic material, in a simple and economic manner, adapted to be readily and securely assembled and exchanged, and are able, by a simple cutting operation, to be shaped so as to conform to any projecting and reentrant corners, window openings, gable walls, to the ground, concrete pedestals, roughcast masonry, and to the upper edge of wall openings, such as windows, doors and the like, so as to form a facing assembly completely covering the masonry of a wall.

In order to achieve this object, the invention provides that each facing panel comprises a mounting groove formed by a bottom rib and a hook-shaped mounting rib and adapted to receive the upper leg of a generally Z-section suspension rail, and that each facing plate has a substantially uniform cross section with a top rib rearwardly offset with respect to the panel's inner surface and adapted to be pressed into engagement with the suspension rail by the bottom rib of the facing plate mounted thereabove.

The invention thus provides a facing panel for a lightweight facing assembly offering the following advantages:

1. The wall facing assembly as a whole is adapted for rear side ventilation throughout.

2. The support structure of the facing assembly consists of substantially Z-sectioned mounting or suspension railsadapted to be mounted in horizontal position, or parallel to the ground, respectively, either by means of spacer pegs directly on the wall masonry or to a base structure consisting for instance of vertically or longitudinally extending wooden battens, so as to provide for full rear side ventilation.

3. The facing panels forming the facing assembly are adapted to be mounted on the substantially Z-sectioned suspension rails without the aid of additional fastening means such as nails, bolts or the like.

4. In case of damage, the facing panels forming the facing assembly are readily replaceable in the finished facing assembly.

5. The facing panels have substantially uniform cross-sectional shape so that they may be produced by an extrusion process.

6. Production of the facing panels by an extrusion process permits the employ of existing equipment and machinery of the producer's plant.

7. The facing panels forming the facing assembly are constructed such that projecting and reentrant corners, window openings and gable walls may be readily formed by performing simple cutting operations on the panels.

8. The facing panels forming the facing assembly are particularly adapted to being stacked so as to permit the panels to be readily and economically transported from the supplier to the building site such as by means of palettes, shrink foil package or the like.

9. The facing panels may include horizontally extending sealing means which may be affixed thereto already at the producer's plant.

10. The facing panels have only a single groove intended not for interlocking of the panels among each other but for mounting or suspending the panels on the substantially Z-sectioned suspension rails extending horizontally on the wall masonry or on a base battening.

11. The facing plates are interlockingly engageable in the horizontal direction without the employ of the groove-and-key principle for this purpose. Moreover, the horizontal interlocking engagement means is substantially planar and extends over the full horizontal length of each facing panel.

12. The horizontal joints extending between the individual facing panels are covered from the rear and of substantially uniform height.

According to a particular feature of the invention, the lateral surfaces of the facing panels defining a vertical joint between panels extends obliquely to the exterior and interior surfaces thereof, the obliquely extending lateral surfaces of said panels being identical and parallel to one another.

On assembly of the facing panels, this feature results in a gap extending obliquely with respect to the wall masonry, so that the extering of spray water is prevented and the Z-sectioned suspension rails affixed to the masonry by means of spacer pegs or to the base battening are completely hidden.

The inventin further provides that the clearance between the head of the fastening bolt or screw for the respective suspension rail and the upper end of the top rib of a lower adjacent facing panel corresponds to the depth of the mounting groove formed by a bottom rib and a mounting rib at least over the area of the height of the head of the fastening screw, and that the holes for the fastening screws of a suspension rail are formed in the lower leg thereof during manufacture at a spacing determined by the units of measurement conventionally employed in the building trade.

This feature enables any facing panel to be raised a distance corresponding to the depth of its mounting groove for removing or inserting such panel from, or into, respectively, the wall facing assembly. Furthermore, mounting of the facing assembly is greatly speeded up, since the holes for the fastening screws in the lower legs of the suspension rails are already formed during production thereof in such a manner that they may be used without any difficulty for fastening the suspension rails to the wall masonry by means of fastening screws having heads of any suitable shape.

For adapting the facing assembly to the inclination of a roof in the case of a gable wall, there are provided facing panels having a greater length than the normal facing panels, their additional length, in Millimeters, being expressed by the formula $$L = a/tg + b.$$

wherein a is the distance between the junction of the mounting rib with the center portion of the panel and the lower edge of the bottom rib (a=about 60 millimeters), and b is the additional length, in millimeters, of the suspension groove remaining after adaptation of the facing panel to the roof inclination and required for safely mounting of such panel, as measured adjacent the junction of the mounting rib with the main protion of the panel.

This feature provides for panels of a special size having the smallest possible length, enabling such panel to be cut over its entire width at an angle corresponding to the roof inclination, so that no pre-shaped trapezoid or triangular panels are required and the conventionally frequently required triangular end panels are integrally connected to such special size panels and do not have to be separately fastened to the suspension rails. Since the additional length L of the special size panels always includes an own mounting rib having a length of at least 20 millimeters, the entire special size panel forming an end portion can be safely and reliably mounted. A wall facing assembly for a gable wall thus merely requires the employ of a number of special size panels the additional length of which is defined by the inclination of the roof covering or the rafters, respectively.

In order to achieve a neat termination of the entire wall facing assembly at its lower end, such as adjacent the floor, at a concrete foundation, at a junction with roughcast masonry, and particularly at the upper edges of wall openings such as windows, doors and the like, the invention provides a facing panel wherein the mounting rib is formed by an enlargement of the top portion directed opposite to the cross section of the top rib and defining the width of the mounting groove.

This feature thus provides a special facing panel for the lower termination of a facing assembly adjacent the floor, a concrete foundation or a junction with roughcast masonry or at the upper edge of wall openings such as doors, windows, and the like, adapted to be cut at the building site, such as by means of a cutting disc, to the required height, and still able to be safely mounted on the support structure in the same manner as a normal facing plate having a mounting rib formed at its lower portion. This special facing panel may be shortened in height up to the lower edge of its hook-shaped mounting rib, or at least to such height that the wall-mounted leg of the z-sectioned suspension rail carrying the special panel is just covered thereby.

In order to avoid cutting off of the suspension rib when shortening the height of a lower-end facing panel, the facing panels employed in a facing assembly for the lower end thereof may be formed such that the bottom rib of each facing panel forming the lowermost row of a facing assembly is downwardly widened by a width a corresponding at least to the total width of a suspension rail, the thickness b of a facing panel and/or the width c of the horizontal joint separating two facing plates mounted one above the other.

This feature thus provides a special facing panel for the lower termination of a facing assembly adjacent the floor, a concrete foundation, a junction with a roughcast masonry, or at the upper edge of wall openings such as doors or windows, such special panels forming the lowermost row of the respective facing assembly and being adapted to be mounted on the lowermost suspension rail in the same manner as the normal facing panels. If need be, these special panels may be cut at the building site, as by means of a cutting disc, to the height to be covered, provided this height is smaller than the width "a". If, however, the height remaining to be covered is substantially greater than the width "a", a further horizontally extending suspension rail may be fastenes to the support structure for mounting a further special facing panel thereon. The latter may also be cut at the building site, as by means of a cutting disc, to the height remaining to be covered adjacent the lower end of the facing assembly.

Figure 2A:
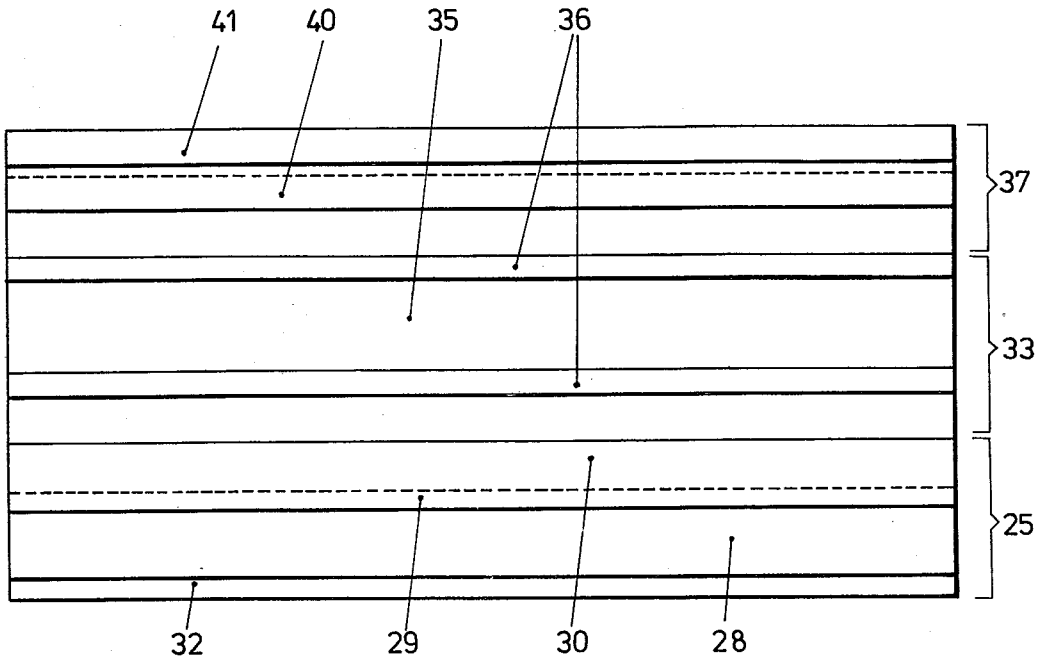
Figure 2:
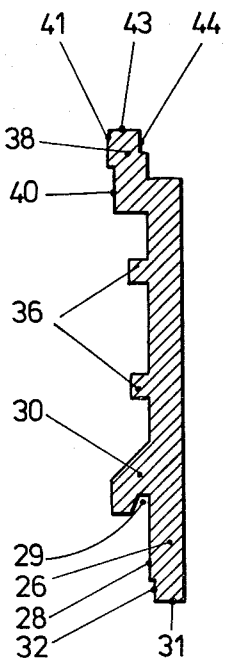
Figure 3:
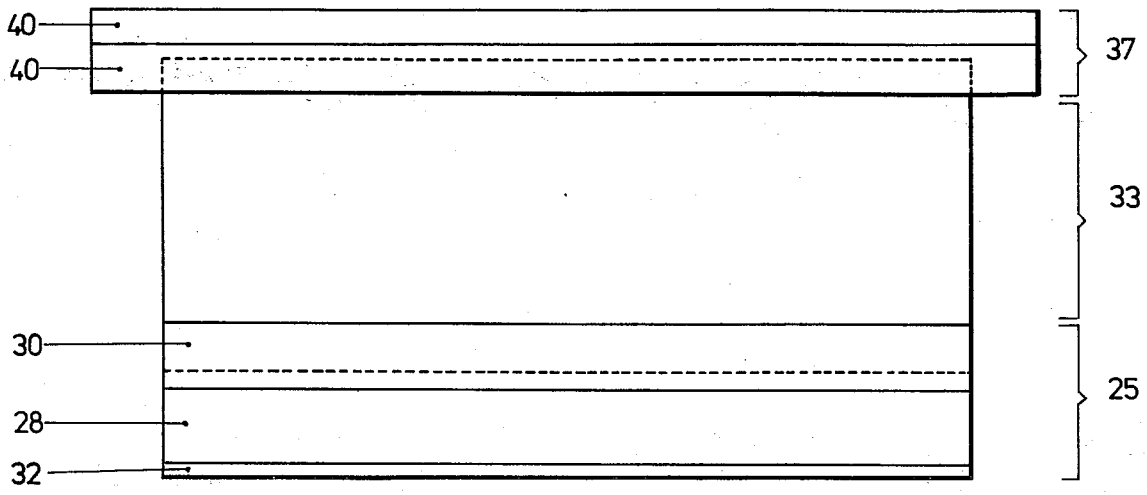
Figure 4:
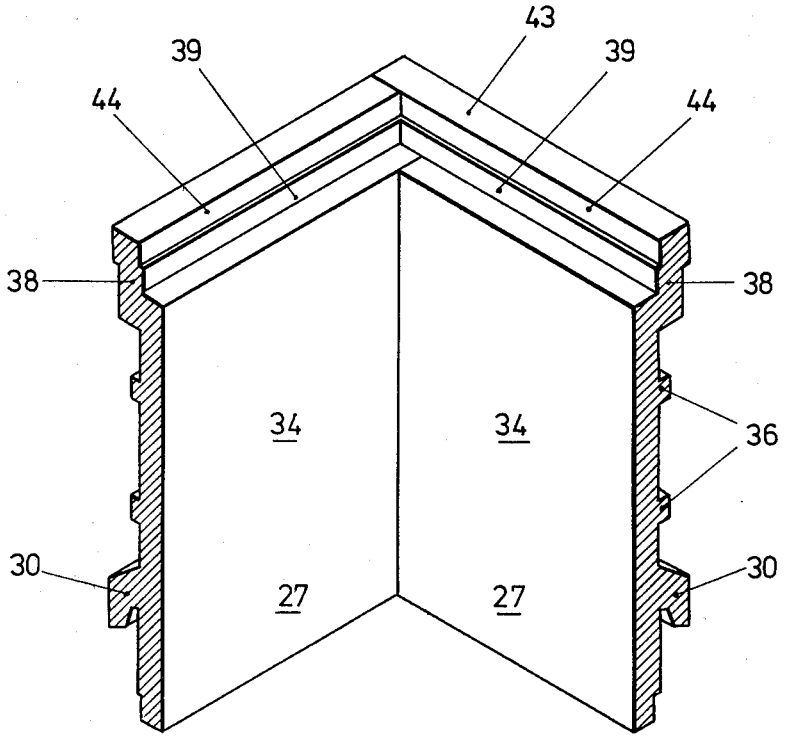
Figure 5:
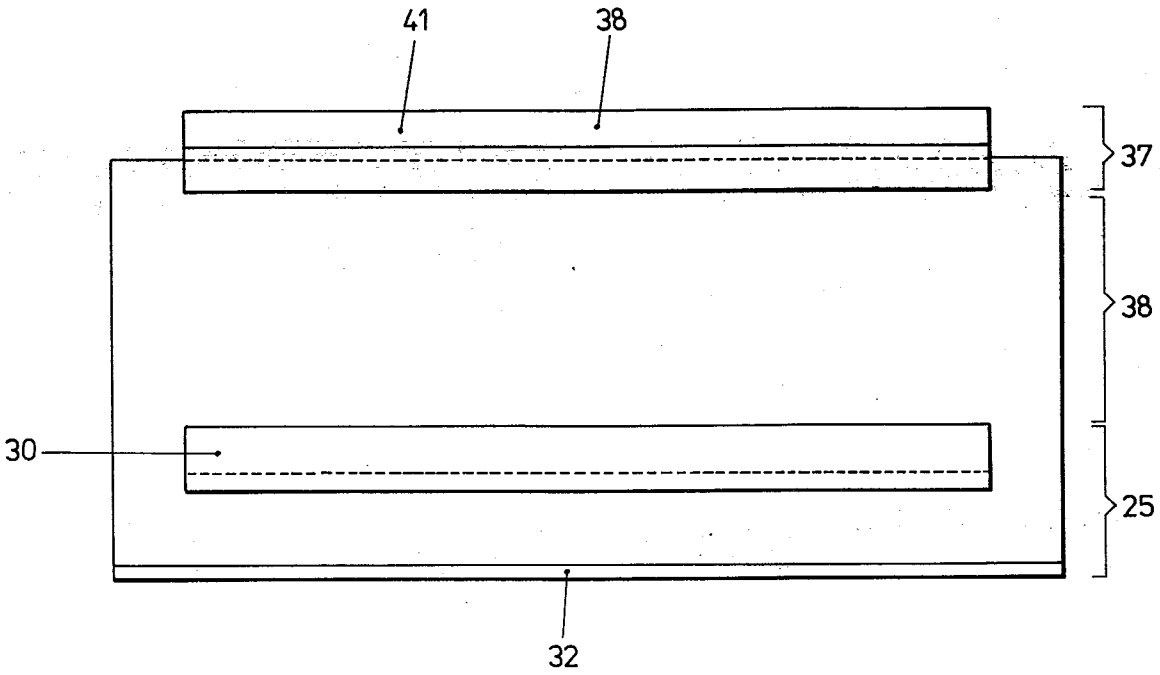
Figure 6:
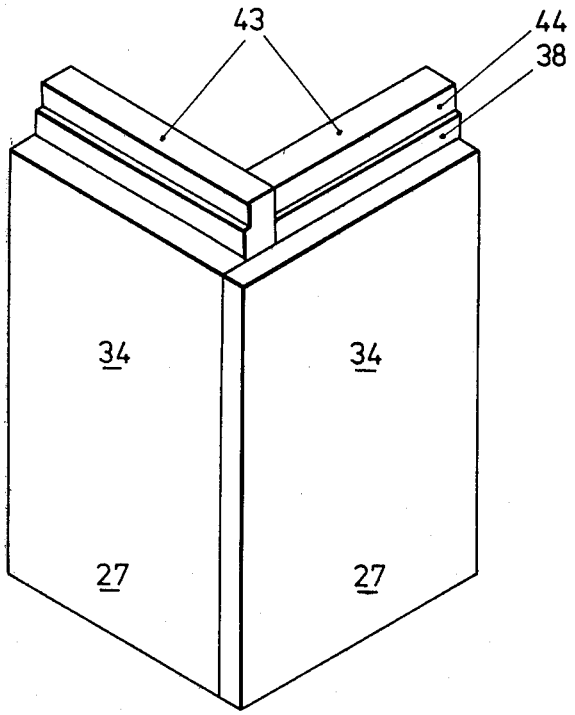
Figure 7:
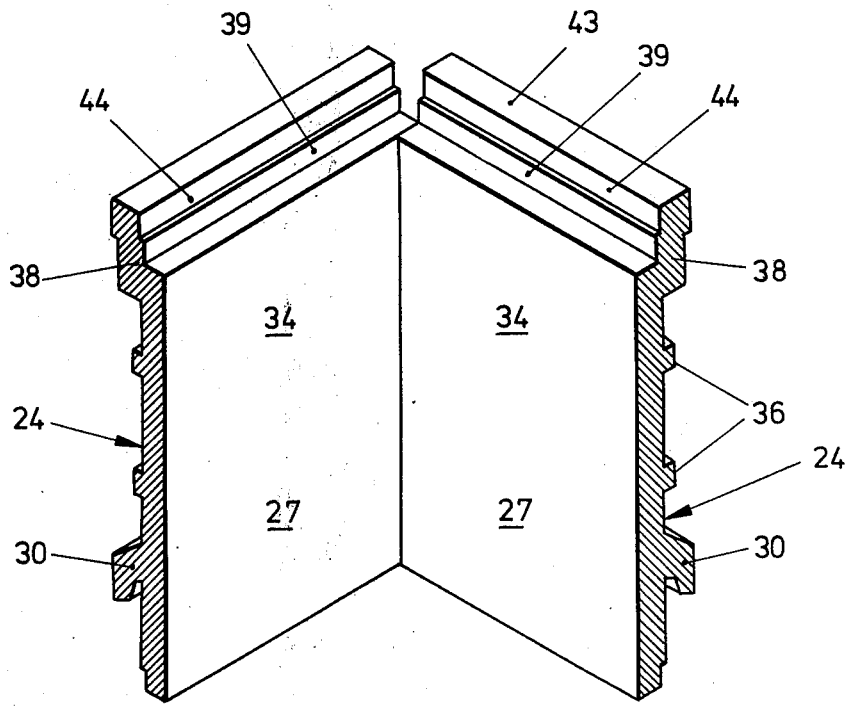
Figure 8:
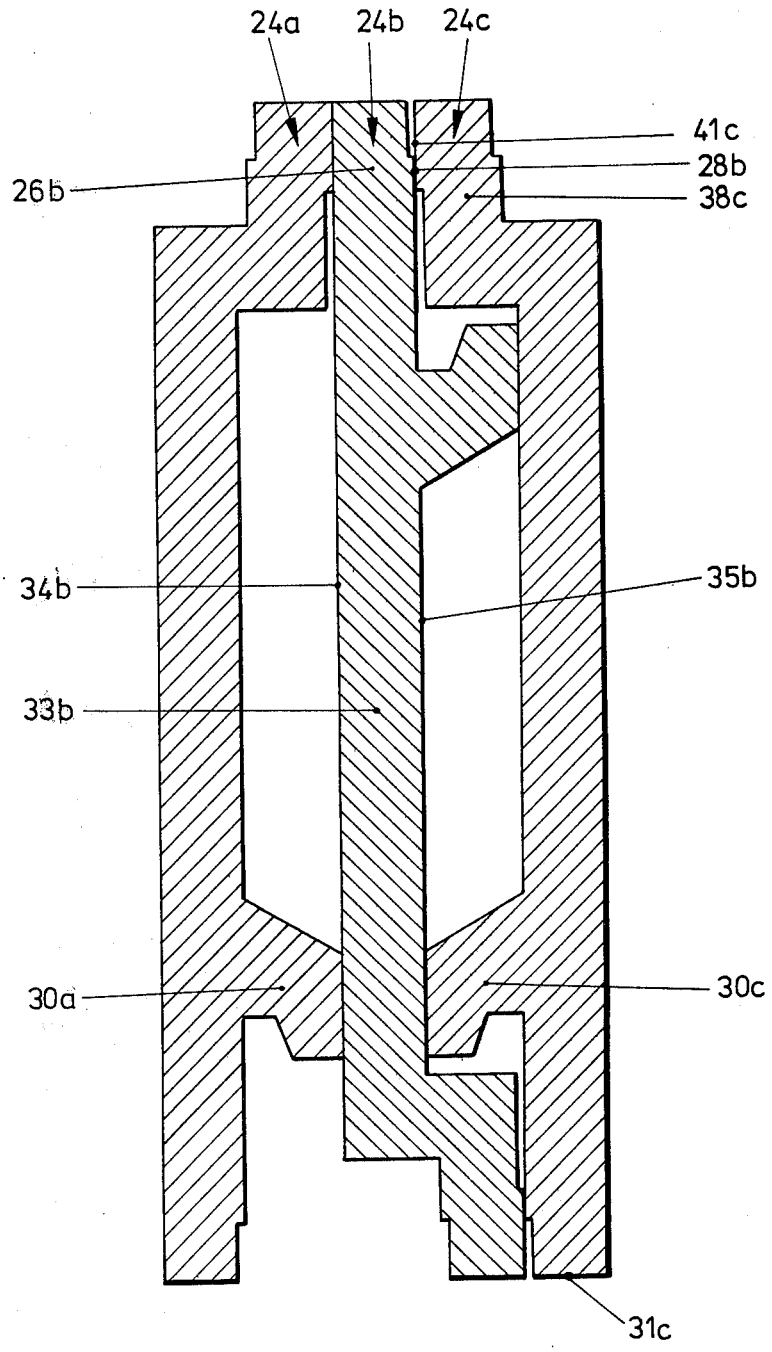
Figure 9:
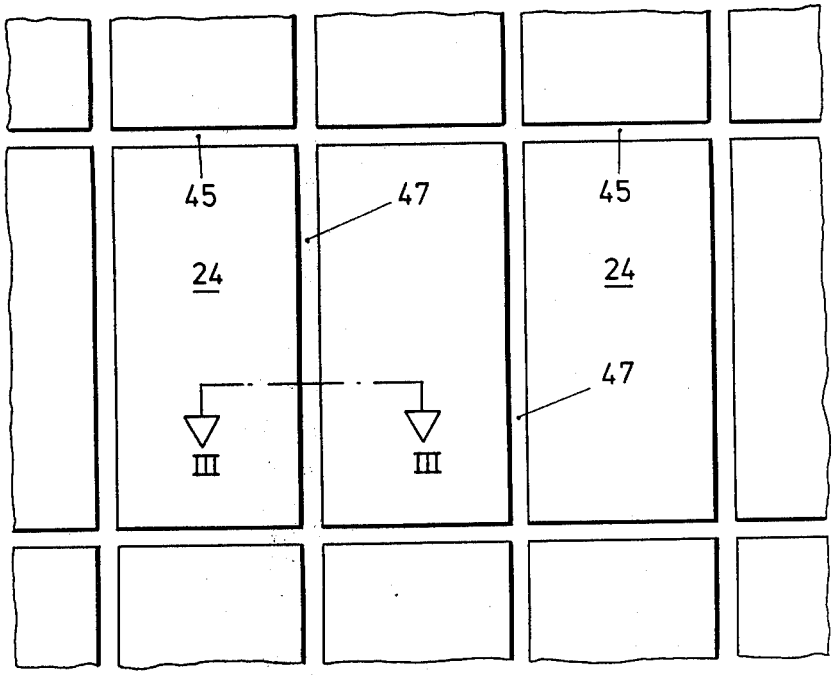
Figure 10:
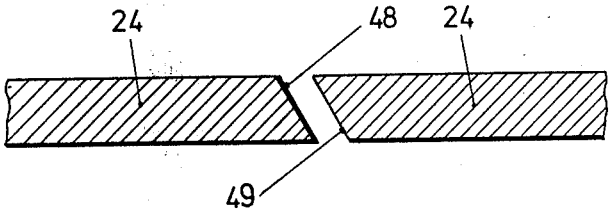
Figure 11:
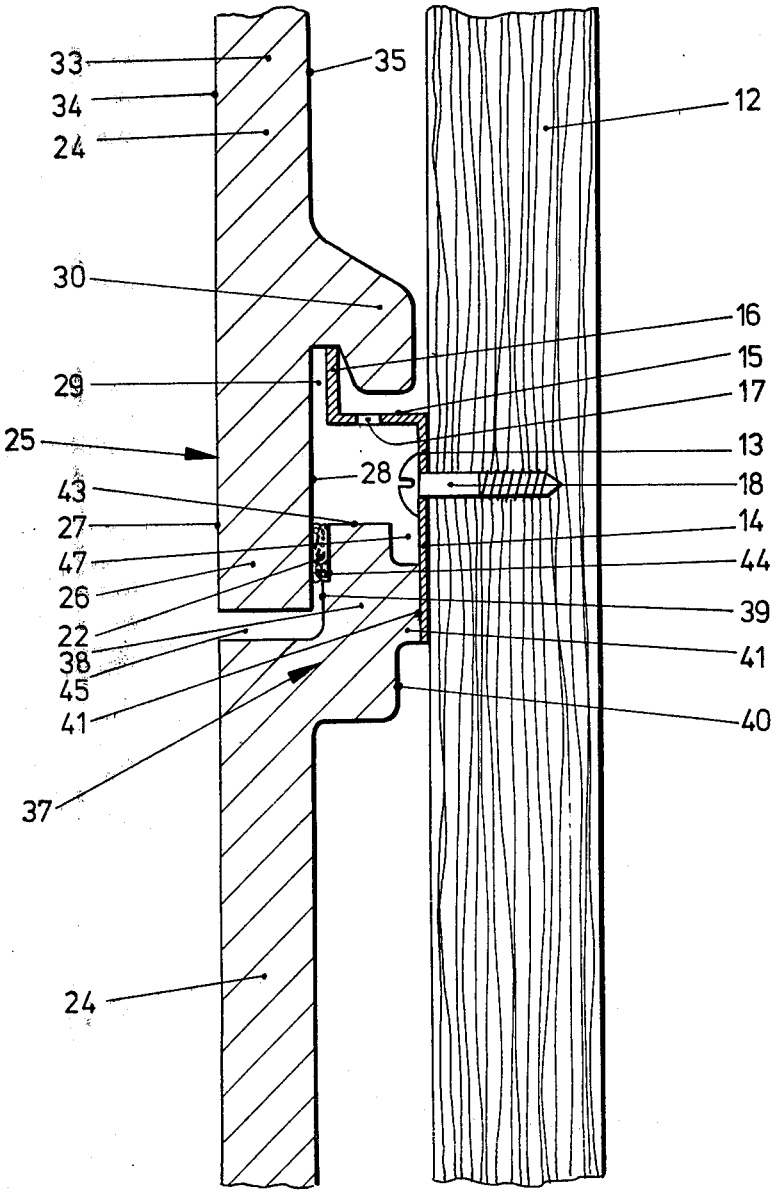
Figure 12:
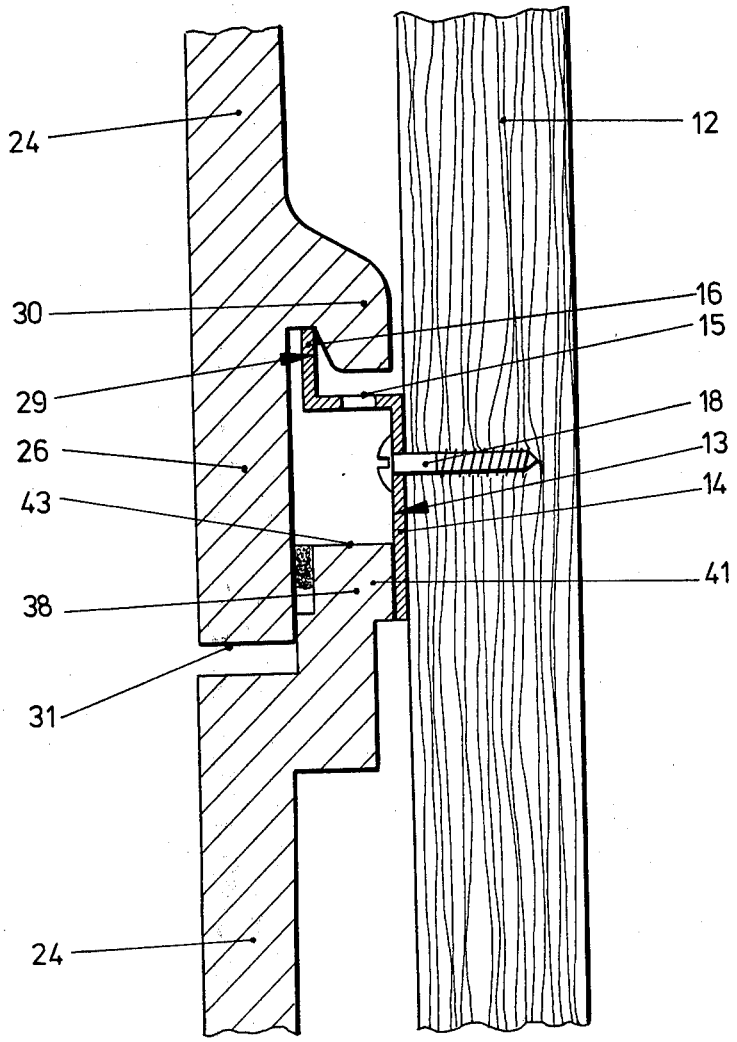
Figures 13, 14:
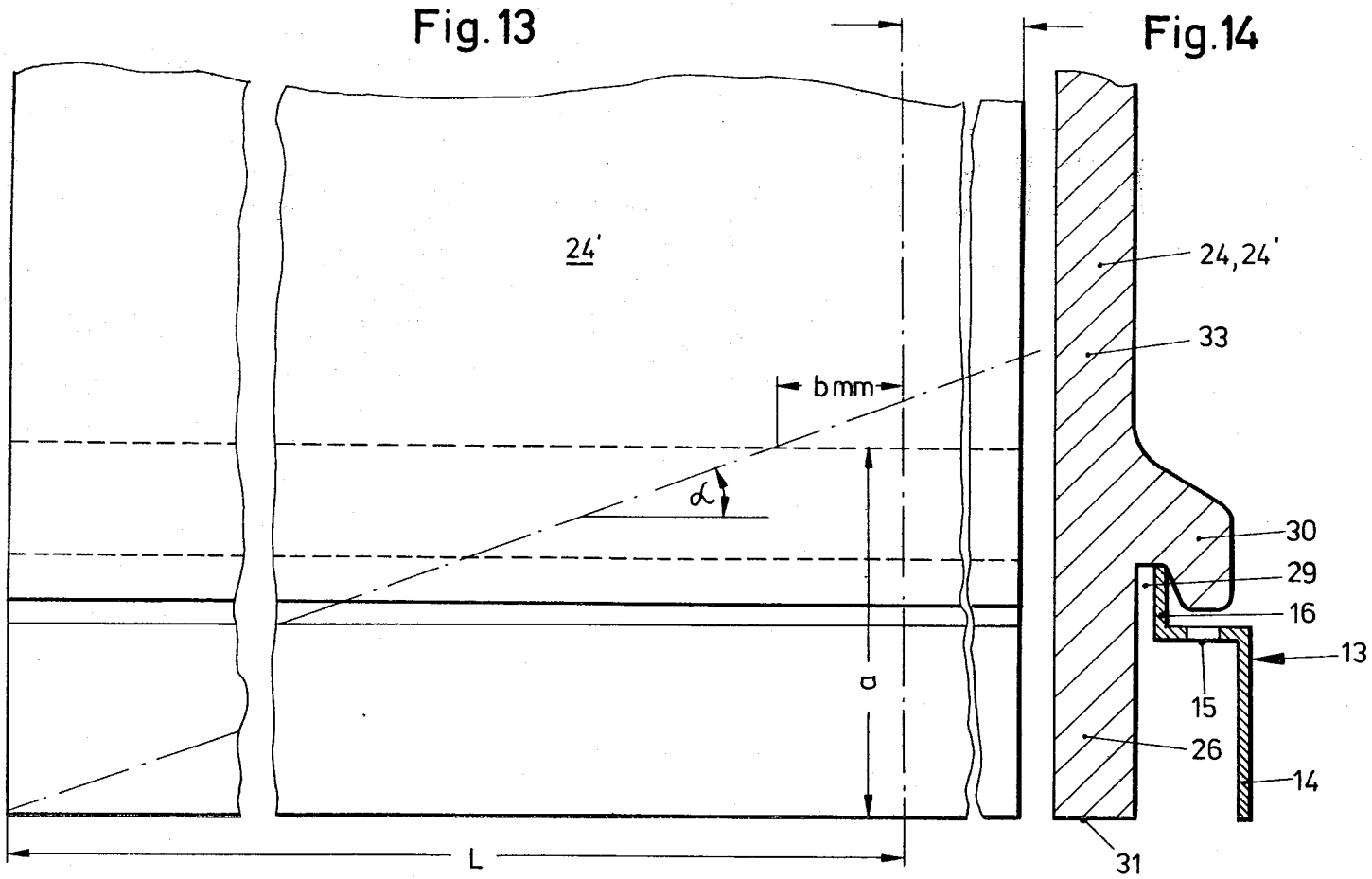
Figure 15:
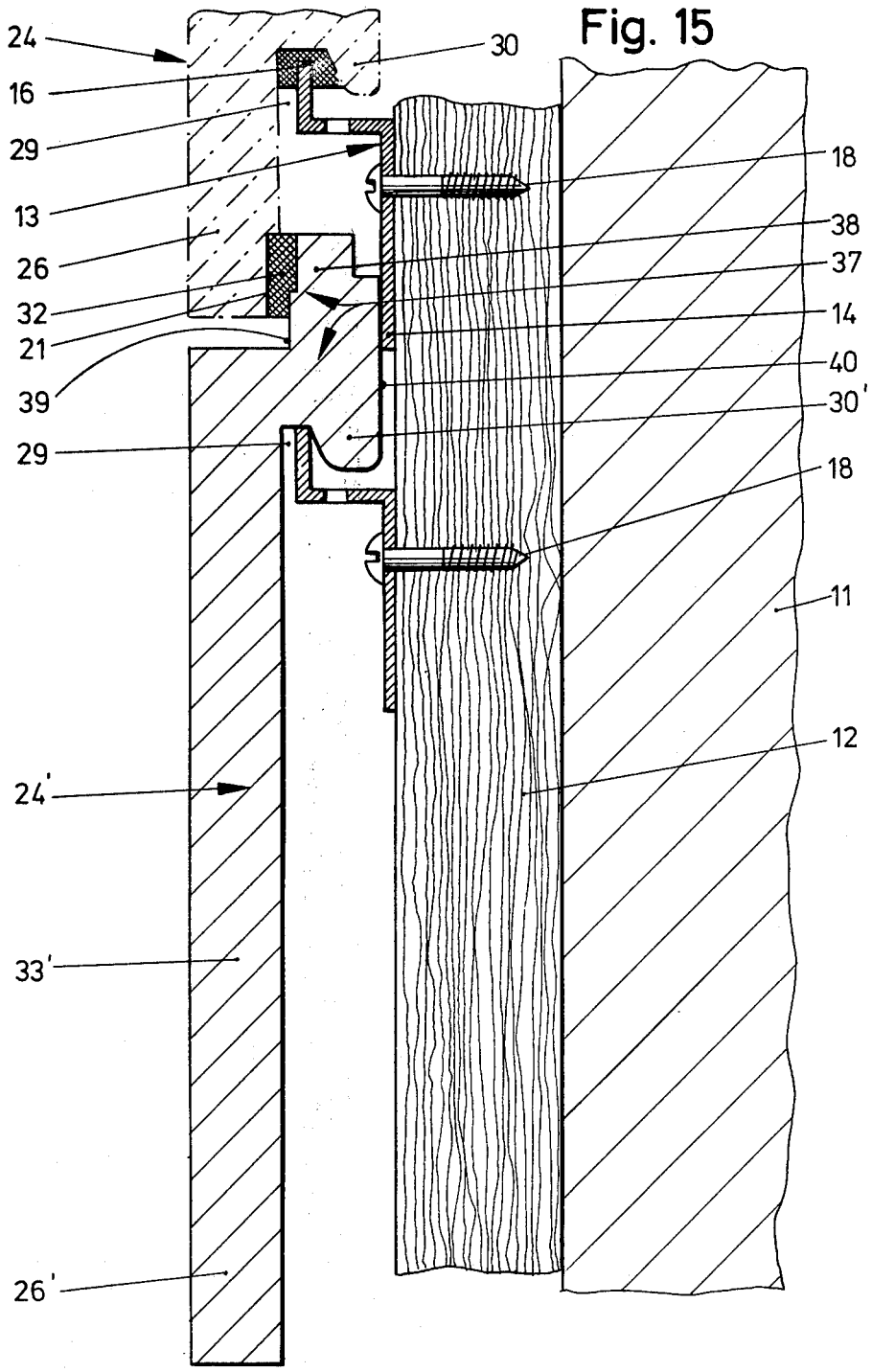
Figure 17:
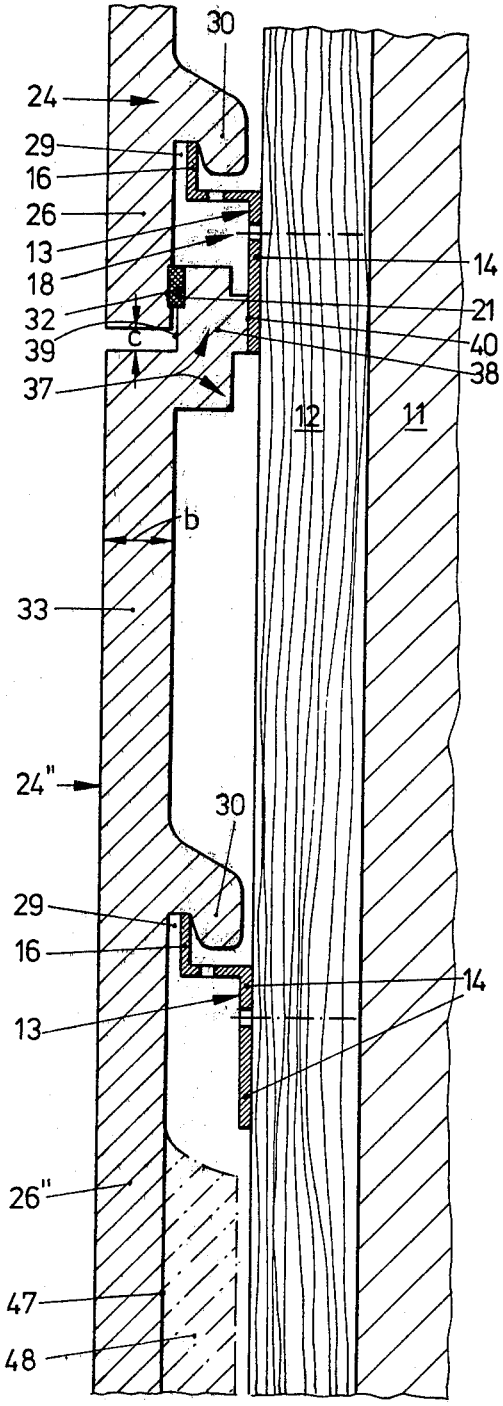
Figure 16:
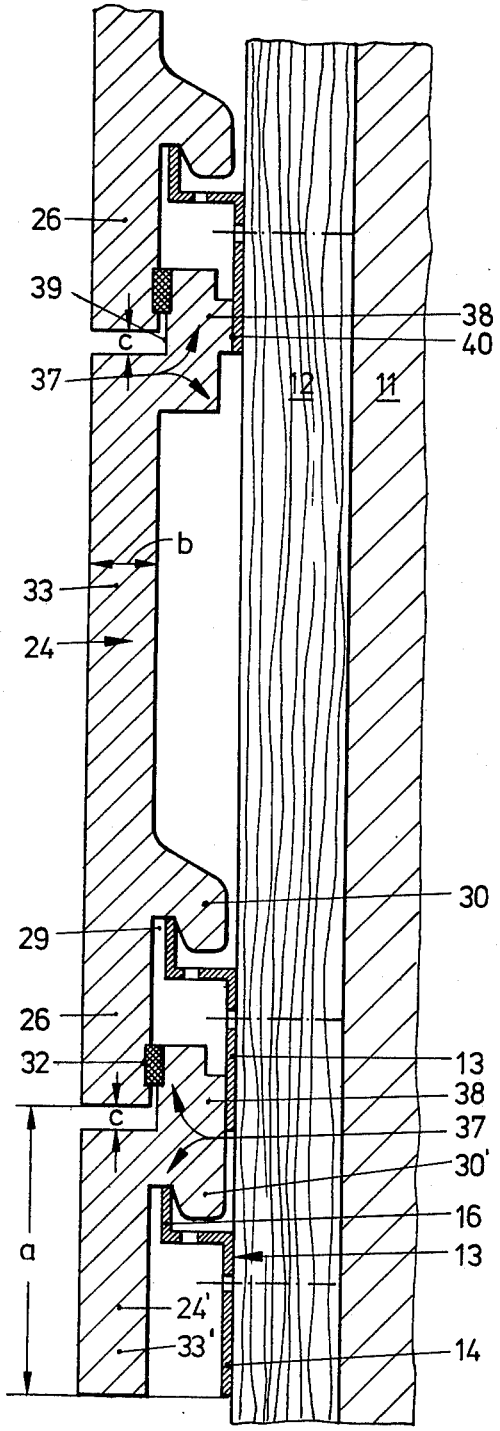

The particular features of the invention will become evident from the following description of embodiments thereof with reference to the accompanying drawings, wherein FIG. 1 shows a schematic sectional view of a wall facing assembly portion comprising three facing panels mounted one above the other, FIG. 2 shows a cross-sectional view, and 2a, a rear view of a single facing panel, FIG. 3 shows a rear view of a facing panel provided with laterial cutouts for use in reentrant corners, FIG. 4 shows a perspective view of a wall facing at a right-angled reentrant corner, FIG. 5 shows a rear view of a facing panels with the ends of its top and mounting ribs being cut off for use in projecting corners, FIG. 6 shows a perspective view of a wall facing at a right-angled projecting corner, FIG. 7 shows a perspective view of a reentrant corner having a facing of normal uncut facing panels, FIG. 8 shows a longitudinal sectional view of three horizontally stacked facing panels, FIG. 9 shows a front view of a portion of a wall facing assembly formed of facing panels according to FIG. 1, FIG. 10 shows a cross sectional view of two horizontally juxtaposed facing panels in the vicinity of a vertical separating gap according to the line III—III in FIG. 9, FIG. 11 shows a sectional view of two vertically juxtaposed facing panels and of a suspension rail fastened to a supporting grid by means of roundhead screws, FIG. 12 shows a sectional view corresponding to FIG. 11 of a different embodiment, FIG. 13 shows a height- and widthwise shortened front view of a special size facing panel for use in a gable wall facing, with a dash-dot line indicating a roof inclination of about 20°, FIG. 14 a cross sectional view of the facing panel of FIG. 13, FIG. 15 shows a longitudinal section of the lower end of a wall facing assembly, with its upwardly extending main portion being shown in phantom lines, FIG. 16 is a longitudinal section of a wall facing assembly according to FIG. 11, particularly of the three lowermost rows or courses of panels thereof, and FIG. 17 shows a longitudinal section corresponding to FIG. 16 of a lowermost facing panel in another embodiment for completely covering the open lower egde of a wall facing assembly.

FIG. 1 of the drawings shows in longitudinal section a portion of a brick wall 11 to which a support battening 12 is affixed. Substantially Z-sectioned suspension rails 13 are fastened to support battening 12 by means of screws 18. Suspension rail 13 has an upper leg 16 spaced from brick wall 11 or battening 12, respectively, for mounting facing panels 24 thereon by means of a respective mounting groove 29.

Facing panels 24 have a substantially uniform cross-sectional shape including a central portion 33 which may be reinforced by longitudinally or laterally extending ribs.

Facing panels 24 mainly consist of a bottom portion 25, main or central portion 33, and a top portion 37. Bottom portion 25 substantially comprises a bottom rib 26 having an outer and an inner surface 27 and 28, respectively. Integrally formed with the upper end of bottom portion 25 is a suspension or mounting groove 29 defined by bottom rib 26 and a hook-shaped mounting rib 30. The lower end of bottom portion 25 is formed by a lower end face 31. Inner surface 28 of bottom rib 26 may be formed with a lower groove 32 for receiving a sealing element 21 therein.

Main portion 33 generally comprises an outer and an inner surface 34 and 35, respectively.

Top portion 37 of each facing panel 24 generally comprises a top rib 38 rearwardly offset by about the thickness of bottom rib 26. Top rib 38 has an outer and an inner surface 39 and 40, respectively, and adjacent its upper end a raised inner surface 41 projecting towards wall 11 and abutting the lower leg 14 of suspension rail 13. Outer surface 39 of top rib 38 may be formed with an upper groove 44 for receiving an upper sealing and compensating element 22.

For facilitating production and for reasons of stability, upper top rib 38, main portion 33 and bottom rib 26 are of substantially uniform thickness.

In order to allow for slight curvatures of the mass-produced extruded facing panels 24 in the assembly thereof, upper top rib 38 may be further offset than necessary for merely receiving bottom rib 26, so that a planar outer surface of the wall facing assembly may be achieved irrespective of such curvatures.

Upper sealing element 22 is received in upper groove 44 of top rib 38 for suitably sealing the wall facing assembly in the horizontal direction and for compensating slight irregularities of facing panels 24. Sealing element 22 may be mechanically attached or glued to facing panels 24 during production thereof. Lower sealing element 21 received in lower groove 32 in bottom rib 26 may be provided in place of or in addition to upper sealing element 22 for performing substantially the same function as the latter. A combination of both grooves and both sealing elements is of course also possible.

In order to achieve intimate support of mounting groove 29 on upper leg 16 of suspension rail 13, a further sealing or compensating element 23 may be attached to upper leg 16. Said element 23 may be fixedly attached to the substantially Z-sectioned suspension rail during production thereof, so that it does not have to be attached at the building site.

Outer surface 34 of main portion 33 and outer surface 27 of bottom rib 26 extend substantially in a common plane, so that the finished facing assembly will also present a planar outer surface interrupted by horizontally and vertically extending grooves or joints. In order to provide for horizontal stackability of facing panels, particularly important for transport purposes, the outer surface of hook-shaped mounting rib 30 and raised surface 41 of top rib 38 also extend in a common plane, so that panels 24 may be stacked in any position relative to one another as shown in FIG. 8.

In order to avoid weakening of the panels through notch effects, the junctures of the various surfaces are rounded with radius 46.

Suspension rails 13 may be provided with holes 17 for permitting any water or moisture condensing in the space between suspension rail 13 and bottom and top portions 25 and 37 of facing panels 24 to drain off. Such holes may specifically be formed in horizontal leg 15 and lower leg 14 of suspension rail 13, with the holes in lower leg 14 serving the additional or alternative purpose of fastening suspension rail 13 to battening 12 or receiving spacer pegs 19 therein. This avoids the need for holes to be formed in the suspension rails 13 at the building site for fastening thereof to support battening 12 or for receiving spacer pegs 19, respectively.

The vertical spacing of suspension rails 13 is selected such that there remains a horizontal joint or groove 45 between vertically adjacent facing panels 24.

Since the forces acting on the wall facing assembly are mainly wind forces exerting substantially pure tensional or traction forces, the height of mounting grooves 29 may be slightly smaller than or equal to that of horizontal separating grooves 45. This permits any facing panel 24 to be raised over such a distance that the hook-shaped mounting rib 30 may be lifted over the upper leg 16 of suspension rail 13.

For additional safety, however, the depth of mounting groove 29 may also be slightly greater than horizontal groove or joint 45. For replacing a facing panel it is then required, however, to lift not only the panel to be replaced, but also the one immediately above it, so as to enable hook-shaped mounting rib 30 of the panel to be replaced to be released from Suspension rail 13. Insertion of a new facing panel is then carried out in a reversed sequence.

Mounting of the wall facing assembly starts with attaching support battening 12 to wall 11. Subsequently, the substantially Z-sectioned suspension rails 13 are fastened to battening 12 by means of screws 18 at the above indicated spacing.

Should a support battening not be required, the substantially Z-sectioned suspension rails 13 are directly fastened to wall 11 by means of spacer pegs 19, so that there is the requisite spacing between facing panels 24 and wall 11 for ventilation purposes.

Starting at the lower end, facing panels 24 are then mounted on upper legs 16 of rails 13 by means of their mounting grooves 29. Since the facing panels are supported on the one hand with their bottom rib 26 against the top rib 38 of the subjacent panels and with their mounting groove 29 by the upper legs 16 of rails 13 on the other, they are prevented from tilting forwardly.

Mounting of the next upper facing panel of the facing assembly causes interior surface 28 of its bottom rib 26 to engage outer surface 39 of top rib 38 of the lower panel, so that raised surface 41 of top rib 38 is pressed against lower leg 14 of suspension rail 13 by the action of the resilient sealing and compensating elements 21, 22. This prevents rattling of the wall facing assembly. The construction of the wall facing assembly thus simply requires mounting of the facing panels including their horizontal sealing means, with the sealing and compensating elements being able to absorb heat tensions and permitting replacement of individual panels.

At the lowermost course or row of facing panels alone there is provided a special supporting batten or the like for supporting the bottom ribs 26. In this manner the entire wall facing assembly may be mounted without encountering any difficulties and without the need for additional fastening elements such as nails, screws or the like for attaching the facing panels. On mounting of the facing panels, sealing or compensating elements 21, 22 and/or 23 are effective to form a hermetic seal in the horizontal direction, and are also able to compensate for slight curvatures and the like.

For the upper termination of the facing assembly, as at window sills, gables and the like, there is provided a termination element such as a profiled sheet metal strip or the like, for retaing, sealing and covering the uppermost panel or panels of the facing assembly.

Since the facing panesl 24 of the facing assembly have an identical parallel-walled cross-sectional shape, they may be mounted in horizontal and vertical rows or in a staggered arrangement. Since all panels of the facing assembly are readily shiftable in the horizontal as well as in the vertical direction, the effects of heat tensions and the like can be compensated without damage to the facing assembly.

The above describes grooves 32 and 44 are effective to form a positive seat for the respective sealing and compensating elements 21 and 22, respectively, so that these elements may be attached at the proper location without difficulty.

According to the invention, a similar groove may be formed in the raised surface 41 of top rib 38 for receiving a further sealing element. Thus sealing and compensating element 23 for instance on the upper leg 16 of rail 13 may be replaced by two sealing strips on the top rib 38, one of which may be located in upper groove 44, while the other one may be located in a groove formed in raised surface 41 or be simply attached to this surface.

It is or course also possible to provide the substantially Z-sectioned suspension rail 13 with a lower leg 14 of such width that it extends beyond the raised surface 41 of top rib 38, so that a sealing element, such as a sealing strip may be attached to the inner surface 40 of top rib 38 to form an end surface seal as well as a rear surface seal. This possibility is not shown, however, in the drawings.

FIGS. 2 and 2*a* show a sectional view and a rear view, respectively, of a facing panel 24 employed in the wall facing assembly according to the invention. As already noted with reference to FIG. 1, facing panel 24 generally consists of a top portion 37, a center or main portion 33, and a bottom portion 25. Top portion 37 generally comprises top rib 38 having upper groove 44 for receiving upper sealing element 22 formed therein. Top portion 38 further comprises rearwardly projecting raised surface 41, inner surface 40 and an upper end surface 43. Main portion 33 ir provided with strengthening ribs 36 extending parallel to top rib 38. Bottom portion 25 generally consists of bottom rib 26 with lower groove 32 formed therein for receiving lower sealing element 21, inner surface 28 and lower end surface 31 of bottom rib 26. Located adjacent bottom portion 25 is mounting rib 30 defining mounting groove 29.

FIG. 3 shows a rear view of an individual facing panel 24 provided with cutouts at its both lateral ends such that only its top portion retains its full length. A facing panel provided with such cutouts is useful for forming a lefthand or righthand reentrand corner of a wall facing assembly according to the invention. The cutouts may be formed at the building site as by means of a cutting disc in the course of assembly of the wall facing. For use in a righthand reentrant corner of the facing assembly, the respective righthand facing panel is cut out at its righthand side, as shown in FIG. 3. The same applies in reverse to a lefthand corner. Facing panel 24 likewise generally comprises top portion 37, main portion 33 and bottom portion 25 as already discussed with reference to FIGS. 1 and 2.

FIG. 4 shows a perspective view of a righthand reentrant corner formed with the aid of a normal facing panel 24 as shown in FIGS. 1 and 2 and a cutout panel according to FIG. 3. The formation of the righthand reentrant corner shall now be described in detail with reference to FIGS. 3 and 4.

Formation of said righthand reentrant corner starts with cutting, as by means of a cutting disc or a similarly suitable tool, one of the two facing panels employed for said corner at its righthand end, as seen from the rear, such that its main and bottom portions 33 and 25, respectively, are removed over a width corresponding to the full thickness of a panel between the outer surface 34 of its main portion 33 and the rear surface of its hook-shaped mounting rib 30 or the raised surface 41 of its top rib 38, respectively. Meanwhile top rib 38 with its inner surface 40 and raised surface 41 is retained at its full length.

In assembling the reentrant corner, the facing panel 24 cut out as shown in FIG. 3 is mounted first. Subsequently, a normal facing panel as shown in FIG. 2 is brought into abutting relationship with the cut out facing panel such that the upper end portion of its main portion 33 abutts the retained end portion of the top rib 38 and the top rib 38 of the normal panel 24 abutts the outer surface 39 of the top rib 38 of the cut out facing panel. This results in a properly formed reentrant corner, such as a rightangled corner, in which the raised surfaces 41 of the top ribs 38 form a right angle, while the top ribs of the two panels employed merge into one another, resulting in a right-angled, planar outer surface combination.

FIG. 5 shows a rear view of a facing panel 24 used for the entire facing assembly and provided with cutouts for forming a lefthand or righthand projecting corner. These cutouts may be formed at the building site as by means of a cutting disc or a similar tool.

The respective cutouts for the formation of reentrant or projecting corners may also be formed during production of the facing panels, for instance from fully ceramic materials, while still in the plastic state.

FIG. 6 shows a perspective view of a righthand projecting corner formed by two facing panels again generally comprising a bottom portion 25, a mein portion 33 and a top portion 37 each. The formation of a righthand projecting corner shall now be described in detail with reference to FIGS. 5 and 6.

Formation of said corner starts with cutting the top rib 38 and the mounting rib 30 of one of the two panels employed to a width corresponding to the thickness of a normal facing panel 24 between the outer surface 34 of its main portion and the rear surface of its hook-shaped mounting rib 30 or the raised surface 41 of its top rib, respectively. The main portion 33 ist retained at its full length.

The required cutout is thus formes as shown in FIG. 5 at the righthand end of one facing panel. Assembly of the projecting corner begins with mounting the entire uncut facing panel at the lefthand flank of the corner. Subsequently the other panel, cut out as shown in FIG. 5, is pushed into abutment with the already mounted panel to form the righthand flank of the corner.

In this position, the retained projecting margin of the main portion 33 of the cut out panel extends over the lateral end surface of the uncut facing panel forming the lefthand flank of the corner, so as to cover it completely. The rearwardly offcut top rib 38 of the facing panel according to FIG. 5 forming the outer surface of the projecting corner abuts the raised surface 41 of the top rib 38 of the uncut facing panel forming the inner or lefthand flank of the corner, while the remaining portion of the mounting rib 30 cut off in accordance with FIG. 5 abuts the rear surface of the hook-shaped mounting rib 30 of the uncut facing panel forming the inner or lefthand flank of the corner.

The same again applies in reverse to the formation of a lefthand projecting corner.

For forming a wall facing assembly having its upper end defined by an inclined roof, such as in a gable wall facing assembly, the facing panels employed for forming said gable may be cut at the building site, as by means of a cutting disc or a similar tool, in accordance with the inclination of the roof, so that they conform to the gable's angle.

If in this instance the bottom portion 25 of the facing panel with its hook-shaped mounting rib 30 are cut back to a smaller extent than the upper portions of the panel, it is possible to safely mount relatively small-sized panel fractions.

FIG. 7 shows a further possibility for forming a reentrant corner by the employ of two facing panels having no cutouts whatever. The reentrant corner is thus formed by two normal facing panels 24 as also employed for the planar surfaces of the wall facing assembly.

In the embodiment of FIG. 7, the lefthand facing panel 24 is pushed into abutting relationship of its lateral edge with the vertical upper leg of the suspension rail of the righthand facing panel. The latter panel 24 forming the righthand side of the reentrant corner is pushed into abbutting relationship of its main and bottom portions 33 and 25, respectively, with the corresponding portions of the first-named panel along the lefthand margin thereof.

FIG. 8 shows the ability of the facing panels **24*a*, 24*b* and 24*c* to be stacked in a horizontal arrangement. Due to the thickness or depth of each panel being substantially equal in the top and bottom portions thereof, the panels may be stacked in practically any arrangement relative to one another. As already mentioned, the thickness of the panels in their top and bottom portions is defined between the outer surface 34 of main portion 33 and raised surface 41 of top rib 38, and the outer or rear surface of hook-shaped mounting rib 30, respectively. Since the two above defined dimensions are equal to each other, the panels can be stacked in various arrangements, two of which will now be discussed with reference to FIG. 8**.

Shown in FIG. 8 are three facing panels **24*a*, 24*b*, and 24*c*, the first and second of which, namely, panels 24*a* and 24*b*, are stacked facing in the same direction but turned about 180° relative to one another, so that the outer surface 34*b* of panel 24*b* rests on raised surface 41*a* of top rib 38*a* and the rear surface of mounting rib 30*a* of first panel 24*a*.**

The third panel **24*c* is also turned about 180° and in addition, reversed relative to second panel 24*b*, so that top and bottom portions of third panel 24*c* rest on bottom and top portions, respectively, of second panel 24*b*. In this case, raised surface 41*c* of top rib 38*c* rests on inner surface 28*b* of bottom rib 26*b*, and the inner or rear surface of hook-shaped mounting rib 30*c* is supported by inner surface 35*b* of main portion 33*b*. In order to provide this stacking configuration, hook-shaped mounting rib 30 of the respective panel is displaced upwardly with respect to lower edge 31 of bottom rib 26 such that a space is provided for receiving top rib 38** of another panel stacked thereon in a reversed position.

Panels may also be stacked of course with the outer surfaces 34 of main portions 33 of two superimposed panels in contact with one another. This stacking configuration is not shown, however, in the drawings.

Further according to the invention, each vertical joint 47 between a pair of horizontaly adjacent panels 24 is defined by chamfered lateral edge surfaces 48, 49 of the respective panels, as shown in FIGS. 9 and 10. Chamfered lateral edge surfaces 48 and 49 of each panel 24 are identical in configuration and extend parallel to one another. An obtuse angle of at least 110° is included between each chamfered surface 48 and 49, respectively, and a corresponding main surface of panel 24, resulting in an acute angle of about 70° being formed between said chamfered surfaces and the other one of said main surfaces. The obtuse angle formed by each chamfered surface 48, 49 may also be greater than 110°, the acute angle being then smaller than 70° accordingly.

In the further embodiment of FIGS. 11 and 12, the substantially Z-sectioned suspension rails 13 are affixed to battens 12 by means of roundheaded screws 18. As already mentioned, the downwardly extending larger leg 14 of rail 13 is formed with holes having a greater diameter than the outer diameter of the stems of screws 18 used in this embodiment for fastening the suspension rails. The center distance between the screws, or holes, respectively, and the horizontal leg 15 of suspension rails 13 has to be no smaller, of course, than the outer radius of a tool employed for fastening screws 18. The holes are formed in the lower leg, i.e. in the leg engaging the supporting structure, during production of the rails. Center spacings of the holes for receiving screws 18 in lower leg 14 of rail 13 are selected in accordance with measuring units of standard measuring systems in the building industry, such as a decimeter or octameter system, or as straight fractions of such measuring units, so that they can be readily used at the building site. On the other hand, holes 17 provided in horizontal leg 15 of rail 13 for drainage of condensed water may be formed at any suitable center spacings.

As already mentioned, holes in lower leg 14 may of course also be used to affix the respective rails directly to the wall masonry by means of spacer pegs. In this case, the lower leg may also be secured between a pair of nuts engaged with a threaded portion of the respective spacer peg, in which case the outer nut takes the place of the head of a fastening screw and projects above the outer surface of lower leg 14.

In order to avoid interference of the projecting heads or nut employed for attaching the suspension rails 13 with the removal or replacement of any lower panel mounted below an upper one, the invention provides that the spacing between the head, or nut, respectively, of the screw or bolt employed for attaching the respective suspension rail 13 for an upper facing panel 24 and the upper edge surface 43 of the top rib 38 of the subjacent facing panel 24 corresponds at least to the depth of the mounting groove 29 formed by a bottom rib 26 and a mounting rib 30, at least adjacent the height of the head of the respective fastening screw 18.

This may be achieved in various ways. Thus top rib 38 of panels 24 may be provided with an upwardly opening recess 47 extending from upper surface 43 into raised surface 41 and corresponding in size to the height of the procecting head of fastening screw 18, so that on raising a subjacent panel, the heads of the fastening screws located thereabove may be received in recess 47 of top rib 38, as shown in FIG. 11. This configuration greatly facilitates replacement of any facing panel.

The same advantages may be obtained by the embodiment of FIG. 12, wherein the top rib 38 of a subjacent panel 24 is shortened by an amount corresponding to the required clearance between the heads of fastening screws 18 of a substantially Z-sectioned suspension rail 13 supporting an upper panel 24 on its upper leg 16 and the upper end surface 43 of the top rib 38 of the subjacent panel 24. The bottom rib 26 of the upper panel 24 is downwardly extended by the same amount, and leg 14, by which suspension rail 13 is affixed to battening 12 or the wall, respectively, is also made wider by a corresponding amount, so that raised surface 41 of top rib 38 is still fully supported by lower leg 14 of rail 13. Also in this embodiment, lower vertical leg 14 of substantially Z-sectioned suspension rail 13 is integrally connected to upper vertical leg 16 thereof by horizontally extending leg 15.

While the facing panels according to the invention offer the advantage that reentrant and projecting corners, window openings and gable wall facings can be formed be performing simple cutting operations on the panels, it is still inavoidable that in case of a facing for a gable wall, there will always be the necessity to employ small-sized end sections in the vicinity of the rafters defining the inclined roof structure. These end sections cannot be safely mounted on the substantially Z-sectioned suspension rails and have therefore to be glued or otherwise attached to the suspension rails in a rather cumbersome operation.

In order to provide for a proper and flawless facing for a gable wall terminating in an inclined rafter or roof construction, the invention employs a further embodiment of facing panels 24. FIGS. 13 and 14 merely show the main portion 33 and the bottom portion 25 of a panel 24' in this further embodiment. Adjacent the upper end of bottom rib 26 of bottom portion 25, a mounting groove 29 is again formed between bottom rib 26 and a hook-shaped mounting rib 30 procecting from the rear surface of the panel. The lower end of bottom rib 26 is defined by bottom surface 31. This panel 24 is also adapted to be supported on a substantially Z-sectioned suspension rail 13 attached directly to a wall or to a supporting grid consisting of battens by means of spacer pegs, or screws, respectively.

In order to enable the small-sized end sections frequently required in a wall facing assembly for a gable wall terminating in a roof structure having an angle of inclination $\alpha$ to be safely supported by the horizontally extending suspension rails 13, the mounting groove of such end sections should have a length of at least 20 mm. If alternatively the mounting groove is to short or has been entirely cut off or otherwise damaged, such end sections have to be fastened in a rather cumbersome operation. This applies particularly in those cases in which the greatest height of an end section having the length L is not or not substantially greater than the distance a between lower end surface 31 of bottom rib 26 and the upper root portion of mounting rib 30, and in which the angle of roof inclination is rather small, for instance $\alpha=20°$, as shown in FIG. 13.

In accordance with the invention therefore, the facing panel 24' is integrally extended by the length of a required end section, thus forming a special-size panel the minimum length L of which, in accordance with the above defined formula, wherein a = 60 mm, the length b of the mounting rib is at least 20 mm, and the roof inclination angle equals 20° (tgα0,364), amounts to $L = 60/0{,}364 + 20 = 165 + 20 = 185$ mm. It would now be possible to fabricate a number of special size panels for various angles of roof inclination, for instance increasing by 5 degree steps, up to an angle of 40°. Experience has shown, however, that for all conventionally employed angles of roof inclination, the minimum length of an end section does not exceed the half length of a normal facing panel, so that in any gable wall facing assembly a complete and flawless coverage of the triangular corners along the rafters defing the roof structure is assured by special size panels the length of which amounts to one and a half of that ot a normal size panel. This provides for a flawless and simultaneously economical facing for gable walls.

It has now also been found that a proper termination of the entire wall facing assembly at the lower end thereof, for instance adjacent the ground, at a concrete foundation, on rough-cast masonry surfaces, and particularly at the upper edges of wall openings such as doors, windows and the like has been possible in the past only if a wall to be faced had been accurately designed and constructed with a view to the dimensions of the facing panels. Even in this case, however, difficulties were frequently encountered, since the clay material employed for making the facing panels may be subject to variations of its shrinkage coefficient, so that an accurate determination of the dimensions was practically impossible.

It is in fact possible, to reduce the height of the lowermost panels of a wall facing assembly by horizontally cutting such panels as by means of a cutting disc, in which case, however, the mounting rib might also be cut off, so that proper mounting of such lowermost panels of a wall facing assembly is then no longer possible.

According to the invention, the facing panels 24 forming the lowermost course of a facing assembly for instance above a concrete foundation, rough-cast masonry, a wall opening or the like are of a somewhat simpler configuration. The height of such lower-end panels 24' corresponds to that of the normal-sized panels 24. Also, the top portion including the top rib has substantially the same configuration as the top portion and top rib of a normal-size panel.

In accordance with the invention, however, the mounting rib 30' of these lower-end panels is formed by an extension of top portion 37 extending opposite to the top rib 38 and defining the width of the mounting groove. The mounting rib is thus relocated upwardly adjacent the top portion 37 of the facing panel, so that the main portion 33' and bottom rib 26' thereof take the shape of a flat panel integrally connected to top portion 37 and having a uniform cross-section with flat front and rear surfaces. The rear surface of top rib 38 and mounting rib 30' lies in a plane extending parallel to the front surface of the facing panel 24'. This facing panel constructed in accordance with the invention may be shortened in height by being horizontally cut, as by means of a cutting disc, so that it is now possible to form the bottom end termination of a wall facing assembly in accordance with the prevailing requirements in an extremely simple manner.

The height of the above described special size panels 24' forming the lower termination of a wall facing assembly may be shortened, as by a horizontal cut performed with the aid of a cutting disc or the like, only to such a dimension that the lower leg 14 of suspension rail 13, by which the latter is attached to wall 11 or battens 12, is still fully covered and thus protected against the influences of wheather and early corrosion, such as indicated at "a" in FIG. 16. If, however, the height of the bottom portion would become smaller than the dimension "a" in FIG. 16, the facing panels 24' forming the lower termination of a wall facing assembly above for instance a concrete foundation, rough-cast masonry, a wall opening or the like may have a somewhat different configuration. The original height of such termination panels 24' is also the same as that of the normal panels 24. Likewise, top portion 37 including top rib 38 has substantially the same configuration as the top portion and top rib of a normal panel.

According to the invention, and as shown in the embodiment of FIG. 17, each panel 24'' forming the lower termination of a wall facing assembly has its bottom rib 26'' extended by a predetermined amount "a". Dimension "a" substantially corresponds to the total width or height of a suspension rail 13, the thickness "b" of the uniform-sectioned portion of a panel 24, 24' or 24'', respectively, and the width or height "c" of the horizontal separating joint between two facing panels mounted one above the other. This configuration of the facing panels 24'' for the lowermost course of a wall facing assembly permits each panel 24'' or its bottom rib 26'', respectively, to be adapted to the height of the lower end of the facing assembly remaining to be completed.

Further if so required, the downwardly extended bottom rib 26'' may be enlarged at the rear surface thereof, at least adjacent its lower portion, such enlargement 48 forming a rear surface extending in a common plane with the rear surface of top rib 38 and mounting rib 30' substantially parallel to the front surface of the panel. This permit the wall facing assembly to be substantially sealed at its lower end in a simple manner.

What is claimed is:

1. A ventilated wall facing assembly comprising:

a plurality of ceramic facing panels each comprising a back side and a substantially planar front side, top and bottom ribs, the back side for facing in the direction of a wall onto which the panel may be secured, the top rib being offset from the front side in a direction toward such securing wall to receive the bottom rib of one of said panels located thereabove, a mounting rib extending from the back side, a mounting groove formed between the bottom rib and the mounting rib, the panel comprising a substantially uniform cross section along the entire length thereof from the top rib to the bottom rib, the top rib and mounting rib offset from the back side toward such wall to provide a hollow ventilating space between the back side and such wall, the panels having lateral end surfaces and a main portion defined between the top and bottom ribs, said assembly having reentrant corners, each reentrant corner formed by two facing panels abutting in right angle relationship, one of said two facing panels, forming a reentrant corner, having a cutout formed by the removal by linear cut of the bottom rib and main portion of a panel, said cutout being adjacent to the front side of the other panel forming such reentrant corner, said assembly having projecting corners, each projecting corner formed by two facing panels abutting in right angle relationship, one of said two panels forming a projecting corner having a cutout formed, by the removal, as by linear cut, of the top rib and mounting rib of a panel, the cutout being adjacent to the lateral end surface of the other panel forming such projecting corner; and suspension means for each said panel for mounting on such wall, each said suspension means being adapted for loose engagement with the mounting groove of the corresponding panel and for extending between the top rib of a lower one of said panels and such wall, the bottom rib of the corresponding panel being adapted for maintaining the top rib of a lower one of said panels in pressure contact with the suspension means.

2. A wall facing assembly according to claim 1 wherein the depth of the cut in one of the two facing panels forming a reentrant or projecting corner is equal to the total thickness of said panel.

3. A wall facing assembly according to claim 1 wherein the cutout of said top rib and of said mounting rib required for forming a projecting corner equals the thickness of the respective facing panel as defined between the outer surface of its center portion and the rear surface of its mounting rib.

4. A ventilated wall assembly comprising:

a plurality of ceramic facing panels each comprising a back side and a substantially planar front side, top and bottom ribs, the back side for facing in the direction of a wall onto which the panel may be secured, the top rib being offset from the front side in a direction toward such securing wall to receive the bottom rib of one of said panels located thereabove, a mounting rib extending from the back side, a mounting groove formed between the bottom rib and the mounting rib, the panel comprising a substantially uniform cross section along the entire length thereof from the top rib to the bottom rib, the top rib and mounting rib being offset from the back side toward such wall to provide a hollow ventilating space between the back side and such wall, and wherein for covering a gable wall terminating in a roof structure having an angle of inclination $\alpha$ measured in degrees fromed by a correspondingly inclined rafter, a panel is increased in length an amount L, measured in millimeters, determined in accordance with the equation:

$$L=a/(tg\alpha)+b$$

where $tg\alpha$ is the tangent of the angle $\alpha$, a is the distance, measured in millimeters, between the upper extremity of the mounting rib and the lower extremity of the bottom rib and b is the length measured in millimeters of the mounting rib required for mounting said panel after fitting the panel to the roof; and suspension means for each said panel for mounting on such wall, each said suspension means being adapted for loose engagement with the mounting groove of the corresponding panel and for extending between the top rib of a lower one of said panels and such wall, the bottom rib of the corresponding panel being adapted for maintaining the top rib of a lower one of said panels in pressure contact with the suspension means.

5. A ventilated wall facing assembly comprising:

a plurality of ceramic facing panels each comprising a back side and a substantially planar front side, top and bottom ribs, the back side for facing in the direction of a wall onto which the panel may be secured, the top rib being offset from the front side in a direction toward such securing wall to receive the bottom rib of one of said panels located thereabove, a mounting rib extending from the back side, a mounting groove formed between the bottom rib and the mounting rib, the panel comprising a substantially uniform cross section along the entire length thereof from the top rib to the bottom rib, the top rib and mounting rib being offset from the back side toward such wall to provide a hollow ventilating space between the back side and such wall; and a substantially Z shaped suspension rail for each said panel for mounting on such wall, each said suspension rail being adapted for loose engagement with the mounting groove of the corresponding panel and for extending between the top rib of a lower one of said panels and such wall, the bottom rib of the corresponding panel being adapted for maintaining the top of a lower one of said panels in pressure contact with the suspension rail, the suspension rail comprising a lower leg adapted for securement to a wall or other supporting surface by means of headed screws, said lower leg contacting the back side surface of the top rib of a subjacent panel, wherein the clearance between the head of the screw of a corresponding suspension rail and the upper extremity of the top rib of the subjacent panel at least over the area of the head of such screw corresponds at least to the depth of said mounting groove, and wherein the top rib of each panel has a recess along the back side of the top rib, said recess extending into the top rib from the upper extremity of the top rib an amount sufficient to provide clearance for the heads of the headed screws during replacement of a subjacent panel.

6. A wall facing assembly according to claim 5 wherein each facing panel is further defined by top, center and bottom portions and wherein the thickness of a facing panel at the top portion thereof equals the total thickness at the bottom portion thereof so that on horizontal stacking of said panels, the outer surfaces of the center portions thereof extend without inclination, parallel to one another.

7. A wall facing assembly according to claim 5 wherein said top rib and/or said bottom rib have grooves formed therein.

8. A wall facing assembly according to claim 5 wherein the top rib has a sealing element receiving upper groove and the lower rib has a sealing element receiving lower groove and wherein at least one sealing element is mounted in at least one of said grooves of said bottom rib and said top rib prior to or during mounting of said facing panels.

9. A wall facing assembly according to claim 5, the mounting rib comprising a hook-shaped mounting rib spaced from the lower extremity of said bottom rib in an upward direction by a distance corresponding at least to the height of said top rib as defined between its upper extremity and its lower extremity formed by the offset from the rest of said facing panel.

10. A wall facing assembly according to claim 5 wherein the top rib has a sealing element receiving upper groove and wherein said upper groove is formed in the top rib of a facing panel and is overlapped by the bottom rib of the panel mounted above it.

11. A wall facing assembly according to claim 10 wherein the top rib of each facing panel is offset toward such wall such a distance that the assembly formed by the facing panels has a substantially planar front surface when said bottom rib overlaps said top rib with a sealing element therebetween.

12. A wall facing assembly according to claim 5 wherein the top rib of each facing panel includes an integrally formed inner surface projecting toward such wall from said front side.

13. A wall facing assembly according to claim 12 wherein a groove is formed adjacent said inner surface of said top rib projecting toward said wall.

14. A wall facing assembly according to claim 13 wherein said groove adjacent the inner surface of said top rib has a sealing element disposed therein.

15. A wall facing assembly according to claim 5 wherein the lower leg of the suspension rail is adapted to be attached to a wall and extends beyond such top rib projecting toward such wall.

16. A wall facing assembly according to claim 5 wherein mounted panels have vertical sides, said vertical sides forming vertical separating joints between each of two horizontally juxtaposed facing panels, the vertical sides having oblique lateral surfaces extending between the panel front side and back side, the lateral surfaces of horizontally juxtaposed facing panels being parallel to one another.

17. A wall facing assembly according to claim 16 wherein one oblique lateral surface forms an obtuse angle of at least 110° with the front side of the panel and a corresponding acute angle of 70° with the back side of the panel and the other oblique lateral surface forms an acute angle of 70° with the front side of the panel and a corresponding obtuse angle of 110° with the back side of the panel.

18. A wall facing assembly according to claim 17 wherein the obtuse angle is greater than 110° and the corresponding acute angle is less than 70°.

19. A wall facing assembly according to claim 5 wherein the upper extremity of the top rib is shortened an amount sufficient to provide clearance between said upper extremity and the heads of the headed screws during replacement of a subjacent panel, the lower extremity of the bottom rib of an upper adjacent panel extended an amount corresponding to the shortened amount of said to rib.

20. A wall facing assembly according to claim 5 wherein the suspension rail further comprises an upper leg, a substantially horizontal leg, the horizontal leg interconnecting the upper and lower legs, and a hole in at least one of the horizontal and lower legs.

21. A wall facing assembly according to claim 20 wherein a sealing element is provided between the upper leg of the suspension rail and the mounting groove of a facing panel suspended thereon.

22. A wall facing assembly according to claim 20 wherein each said facing panel is adapted to provide a clearance between the panel and the horizontal leg of said suspension rail enabling a lower facing panel to be shifted upwardly when said rail is fastened to such wall.

23. A wall facing assembly according to claim 20 wherein the center spacing between the heads of the headed screws and the horizontal leg of said suspension rail permits removal and replacement of such screws.

24. A wall facing assembly according to claim 20 wherein each facing panel is further defined by top, center and bottom portions and wherein said mounting rib is formed by an extension of said top portion extending opposite the cross section of said top rib and defining the width of said mounting groove.

25. A wall facing assembly according to claim 24 wherein the panels have a substantially planar front side, the top rib has a rear surface and the mounting rib has a rear surface, said rear surfaces lying in a plane that is parallel to the panel front side.

26. A wall facing assembly according to claim 24 wherein the height of a facing panel having its mounting rib formed integrally with the top portion corresponds to that of a panel having the mounting rib formed at its bottom portion.

27. A wall facing assembly according to claim 20 wherein each facing panel forming the lowermost course of such wall facing assembly has its bottom rib downwardly extending by an amount corresponding at least to the total width of a suspension rail, the thickness of a facing panel, and the width of a horizontal separating joint between two facing panels mounted above one another.

28. A wall facing assembly according to claim 27 wherein said bottom rib at least adjacent its lower extremity has a portion of rearwardly projecting increased thickness such that the rear surface of said increased thickness portion lies in a plane common with the rear surfaces of said mounting rib and said top rib, said common plane extending substantially parallel to the front side of said panel.

* * * * *